US011267540B1

(12) United States Patent
Appell

(10) Patent No.: US 11,267,540 B1
(45) Date of Patent: Mar. 8, 2022

(54) SURFBOARD REAR FOOT POCKET

(71) Applicant: Thomas Edward Appell, Coto De Caza, CA (US)

(72) Inventor: Thomas Edward Appell, Coto De Caza, CA (US)

( * ) Notice: Subject to any disclaimer, the term of this patent is extended or adjusted under 35 U.S.C. 154(b) by 0 days.

(21) Appl. No.: 17/373,099

(22) Filed: Jul. 12, 2021

(51) Int. Cl.
*B63B 32/73* (2020.01)
*B63B 32/40* (2020.01)

(52) U.S. Cl.
CPC ..... *B63B 32/45* (2020.02)

(58) Field of Classification Search
CPC ..... B63B 32/45; B63B 32/73
See application file for complete search history.

(56) References Cited

U.S. PATENT DOCUMENTS 5,308,271 A * 5/1994 Foulke ..... A47K 3/002 441/74
5,484,312 A * 1/1996 Zepeda ..... B63B 32/45 441/74
6,193,276 B1 * 2/2001 Sottile ..... A63C 17/01 280/816
2003/0124923 A1 * 7/2003 Mercer ..... B63B 32/45 441/74
2014/0144050 A1 * 5/2014 Smith, III ..... A43B 13/00 36/137

* cited by examiner

*Primary Examiner* — Stephen P Avila

(57) ABSTRACT

A foot pocket comprising a main body and a traction pad for attachment to the tail end of a surfboard deck. The main body provides a pocket for the surfer's foot so the surfer may push back or lift up the tail end of the surfboard with the rear foot while maintaining a secure rear foot point of contact with the surfboard. The traction pad material has a surface that is easy to grip with the surfers rear foot and is permanently affixed to the front side of the main body and extends forward onto the surfboard deck for the surfer to stand on while surfing. The foot pocket can be made with or without a cut-out for the surfers ankle. The foot pocket features a flat base for attachment to the deck of the surfboard by adhesive.

1 Claim, 16 Drawing Sheets

Surfboard Foot Pocket With
Two Piece Curved Main Body
Three-Piece Traction Pad
No Scale Surfboard Foot Pocket With
Two Piece Curved Main Body
Three-Piece Traction Pad
No Scale Surfboard Foot Pocket With Traction Pad Material
Side View
No Scale Surfboard Foot Pocket
Two Piece Main Body
Three Piece Traction Pad
Top View
No Scale Surfboard Foot Pocket With
2 Piece Angled Main Body
3 Piece Traction Pad
& Horizontal Overhang
Goofy Foot Stance
Perspective 3D View Shown With Layered and Glued Material Surfboard Foot Pocket With
2 Piece Angled Main Body
3 Piece Traction Pad
Horizontal Overhang
Regular Foot Stance
Shown With Layered and Glued Foam Material
No Scale Surfboard Foot Pocket With
One Piece Curved Main Body
Three Piece Traction Pad
Curved Overhang With Ankle Cut-out
Goofy Foot Stance
No Scale Vertical Surfboard Foot Pocket With
Two Piece Angled Main Body,
Three Piece Traction Pad
No Overhang
Goofy Foot Stance
Layered and Glued Foam
No Scale Surfboard Foot Pocket With
Two Piece Angled Main Body
Three Piece Traction Pad
& Short Horizontal Overhang
Goofy Foot Stance
Layered and Glued Foam Surfboard Foot Pocket With
1 Piece Angled Main Body
Short Traction Pad
Horizontal Overhang
Goofy Foot Stance
Layered and Glued Foam Surfboard Foot Pocket With
1 Piece Angled Main Body
Layered and Glued Material
Horizontal Overhang
Single Piece Traction Pad Surfboard Foot Pocket
Single Piece Main Body
Single Piece Traction Pad
Curved Pocket Area
Molded Material
No Scale Surfboard Foot Pocket
With Single Piece Traction Pad
Top View
No Scale Surfboard Foot Pocket With
2 Piece Angled Main Body
3 Piece Traction Pad
Long Horizontal Overhang
Goofy Foot Stance
Shown With Molded Material Surfboard Foot Pocket With
One Piece Angled Main Body
Three Piece Traction Pad
Short Horizontal Overhang
Goofy Foot Stance
Shown With Molded Material Surfboard Foot Pocket With
1 Piece Angled Main Body
Molded Material
Longer Horizontal Overhang
Single Piece Traction Pad
No Scale Surfboard Foot Pocket
Rear View
No Scale

SURFBOARD REAR FOOT POCKET

BACKGROUND OF THE INVENTION

The present invention pertains to surfboards. The upper surface of the surfboard is referred to as the deck. The back wherein the fins reside on the underside is referred to as the tail. Surfboards have a leash pin hole with a pin for attaching a leash near the tail on the deck. The present invention pertains to creating a foot pocket located as close to the tail of the surfboard as is possible, on the deck of the surfboard, that is integrated with a surfboard traction pad for the purpose of allowing the surfer to push the tail of the surfboard back, and/or up with the rear foot while maintaining a secure point of contact with the surfboard.

Most surfers prefer shorter surfboards which are capable of much more aggressive turning than longer surfboards. Surfers stand on the deck with one foot planted near the tail (rear) and the forward (front) foot planted nearer the front of the surfboard. If the left foot is at the rear the surfer's stance is called goofy foot. If the right foot is at the rear the surfer's stance is called regular foot. It's easiest to turn a surfboard when the rear foot is at a strategic position very close to the tail. Surfboard traction pads, which have a raised section at the back, typically angled up at 45°, are affixed to the surfboard deck at said strategic position and are used by surfers so they can "feel" with their foot where the back of the surfboard is and execute a good turn. Traction pads also aid with helping the surfer to not slip off of the surfboard. The traction pad raised area at the back gives some support for the surfer to push the back of the board when executing a turn.

The top of the surfboard in front of the traction pad is either covered with wax or additional traction pads to prevent the surfer from slipping. U.S. Pat. No. 4,840,590 is an example of this. These designs help the surfer from slipping off of the surfboard. However, when attempting an aggressive turn or aerial manuever, it's very difficult for the surfer to maintain a secure point of contact with the surfboard deck because there's nothing holding the surfer's foot to the board, and it's easy to fall off.

Other designs for surfboards which allow the surfer to secure a point of contact with the surfboard and lift the surfboard with the feet include a foot piece in which the surfer's foot can be placed. An example of such a design is U.S. Pat. No. 5,484,312. The problem with this and similar designs is that the foot piece is located in the area where the surfer needs to lay down to paddle. This obtrusive foot piece makes paddling uncomfortable. Also, this foot piece is not located on the tail where the surfer's rear foot needs to be secured. Thirdly, this foot piece is intended for using the inside of the surfer's front and back feet to press against and provide stability which is not what surfers are used to doing. Surfers use the outside of the rear foot to press against the traction pad, provide stability, and help with "pushing" the back of the board through the lip of the wave to help execute a smooth turn.

The problem with existing surfboard traction pads is that the surfer's rear foot is resting on the traction pad with no way to secure said foot to said traction pad. When performing an aerial maneuver or turn it's easy for said foot to become disengaged from the surfboard traction pad and the surfer falls off. Also, it's easy for surfers to fall off while attempting to push the tail of the surfboard back with said foot using current traction pads having a raised area that's angled at 45°. Also, existing surfboard traction pads have a narrow rear end, and only display the product name on the face of the traction pad where the surfers stand, not utilizing the rear of the pad for any product branding.

The present invention comprising a foot pocket and integrated surfboard traction pad that doesn't get in the way of the surfer when laying on the board to paddle, and allows the surfer to "push" and/or "lift" the tail of the surfboard with the rear foot while maintaining secure contact with the surfboard, with the front foot free to move to the optimum position for ease in execution of turning and aerial maneuvers with a tall, rear end suitable for displaying the name of the product and/or an advertising message or logo.

SUMMARY OF THE PRESENT INVENTION

The present invention creates a foot pocket comprising a main body 1, 11, 27, 36, 40, 41, and traction pad 2, 3, 4 with a flat bottom that allows the surfer to use only the rear foot to push the surfboard back with the outside of the rear foot and/or lift the surfboard tail out of the water by pressing with the top of the rear foot against the underside of said foot pocket while maintaining a secure point of contact with the surfboard. Said foot pocket also comprises a rear end tall enough to display the name of the product 50 and/or an advertising message or logo 50 stamped into the vertical surface 51 of the rear end of said foot pocket main body 1, 11, 27, 36, 40, 41. Preferably the name of the product 50 and/or an advertising message 50 shall be the words "GET AIR" but may be any number of words in any language with or without an accompanying logo or graphic design.

EVA rubber foam or some other suitable material with a surface manufactured for making the interior of the foot pocket area easy to grip with the surfer's foot without slipping, hereinafter called traction pad material, is to be permanently affixed using glue or any suitable permanent adhesive to the inside of the front of the main body that will come into contact with the surfer's foot. This traction pad material will extend forward towards the front of the surfboard, affixed to the surfboard with adhesive, as far as is needed to provide optimum traction for the surfers rear foot while surfing 2, 3, 4, 16.

The foot pocket will be affixed at the tail end of the surfboard slightly in front of the leash pin hole 8. 27, 36, 48 show representations of the preferred embodiment. The foot pocket can have an overhang of any length that's curved 42, or angled 14, 43 that allows the surfer to lift the tail of the surfboard with the top of the back foot. The foot pocket can also have a vertical back with no overhang 29 and be used primarily for pushing the tail of the surfboard back. The foot pocket, in angled or curved designs, can have a cut out for the surfer's ankle 48.

The foot pocket of the present invention provides the advantages of having the foot pocket area out of the way of where the surfer needs to lay for paddling, provides maximum push and lifting options for the surfer at the tail end of the board by utilizing only the back foot, keeps the front foot free to move to wherever is best for any maneuver, and allows the back foot to be easily removed from the pocket area when falling or paddling.

The main body of the foot pocket would be made of material of sufficient density and rigidity to withstand pressure from the surfer's foot without breaking, preferably EVA rubber foam or plastic, but also exhibiting optimal flexibility, and the inside area that would be touching the surfers foot lined with traction pad material which continues out in front of the foot pocket area acting as an integrated surfboard traction pad 2, 3, 4, 9, 16.

The traction pad would be permanently affixed to the inside of the foot pocket with adhesive 2, 3, 4, 9. The foot pocket main body is to have a cut-out 6 for the leash pin hole so said foot pocket may be placed as far towards the tail end of the surfboard as is possible.

The foot pocket main body can be a single piece of molded material 11, 48, a single piece of material comprising several layers glued together 1, or for ease of installation can be two pieces that abut together after installation comprising several horizontal layers of material glued together 27, 36.

For adhesive installations, the bottom of the main body and traction pad material extending out from the front of the foot pocket would be pre-coated to the base surface along it's entire surface with adhesive, and be part of the manufactured device. Many synthetic bonding agents and adhesives are available and suitable for the application of this adhesive.

Because the adhesive layer has tackifying characteristics which result in it's adhesion to the surfboard deck upon contact, it's preferable that layer of coating be protected, prior to use, from adhesion to an undesired surface by some protective means. In the preferred embodiment the protective means is comprised of a paper with it's waxed surface in contact with the coating area and being waxed so as to provide ease of removal of the paper, such as peeling off action. Upon removal of the protective paper the adhesive is fully exposed and ready for adhesion to the desired surface.

In order to mount the foot pocket to the deck of the surfboard in adequate fashion so it does not dislocate from the deck upon use, the surface of the deck must be suitably prepared. It's necessary to remove any interfering fluids and substances, such as sand, oil and wax, which are on the portion of the deck where the foot anchor is to be mounted. Removal can be accomplished by a number of ways known in the art, such as cleaning, scraping or by applying a suitable solvent such as acetone.

Upon this preparation the foot pocket is ready to be mounted to the surfboard. The protective paper is removed, and the base surface of the foot pocket is positioned relative to the location where the mounting is to occur. The protective layer is removed exposing the adhesive layer for contact with the surfboard deck. Pressure is then applied in sufficient amount to secure the bonding of the adhesive to the board. In order to adequately assure the completeness of the bonding, it's recommended that before use a sufficient waiting period be undertaken after pressing the adhesive to the deck. The surfboard with foot pocket is now ready for use.

The foot pocket can be manufactured with a single piece traction pad 16, or for ease of affixing to the surfboard, the foot pocket can be manufactured with a multiple piece traction pad. In such cases, it may be designed to have 2 or more pieces 2, 3, 4. In a single piece foot pocket design, whether molded or layered and glued material, the traction pad can be a 2 piece design comprising a rear piece affixed to the foot pocket main body underside 9 with adhesive, said rear piece having left and right sides 2, 4 that extend forward in a contiguous manner to the front of the traction pad that are to be affixed to the surfboard with adhesive upon installation for the surfer to stand on, and a center piece 3 that abuts the front of the foot pocket main body and inside of said left and right pieces extending forward.

In a 2 piece foot pocket 27, 31, 32, 36 whether molded or layered and glued material, the traction pad may comprise left 4 and right 2 pieces that are affixed to the underside of the foot pocket 9 with adhesive that extend forward in a contiguous manner to the front of the traction pad 47 for the surfer to stand on. The center piece 3 abuts the front of the foot pocket and inside edge of the left and right sides of the traction pad and continues to the front of the traction pad 3, 47. The surfer would feel a continuous surface on the bottom of the board where the three pieces of the foot pocket and integrated traction pad join.

There can also be a cut-out area on the main body 48 in curved or angled designs for the surfer's ankle to be able to have more range of motion without being constrained by the overhang at the front of the foot pocket.

Surfers enjoy being stylish by riding bright colored surfboards of many colors. For this reason, the foot pocket can be of any color or combination of colors that would be suitable for complementing the look of any manufactured surfboard, and also be manufactured in different sizes to accommodate feet of different sizes.

The rear of the foot pocket main body has a vertical surface 51 whether the design comprises layered and glued foam material or one-piece molded material upon which a product name, branding and/or advertising message 50 can be displayed. Said product name, branding and/or advertising message 50 may be carved or molded into the rear end of said foot pocket and/or stamped on with permanent ink. Preferably the message 50 shall be the words "GET AIR" but may be any number of words in any language with or without an accompanying logo or graphic design. The product name, branding, and/or advertising messaging 50 displayed on the vertical rear end 51 of said foot pocket may be carved into and/or stamped with permanent ink upon the main body 1, 5, 27, 36 of the foot pocket, or may be carved into or stamped with permanent ink upon a separate piece of EVA foam attached to the rear of the foot pocket main body 1, 5, 27, 36 with adhesive.

These embodiments are not limited to the specific embodiments mentioned above and other forms of the invention are within it's spirit and scope as set forth in the claims hereafter.

DETAILED DESCRIPTION

Various terms used herein are intended to have particular meanings. Some of these terms are defined below for the purpose of clarity. The definitions given below are meant to cover all forms of the words being defined (e.g. singular, plural, present tense, past tense). If the definition below diverges from the commonly understood and/or dictionary definition of such term, the definitions below control.

Embodiments described herein include a foot pocket comprising a main body and a traction pad for attachment to the tail end of a surfboard deck. The foot pocket described herein advantageously provides a pocket for the surfer's foot so the surfer may push back or lift up the tail end of the surfboard with the rear foot while maintaining a secure rear foot point of contact with the surfboard. The traction pad material has a surface that is easy to grip with the surfers rear foot and is permanently affixed to the front side of the main body and extends forward onto the surfboard deck for the surfer to stand on while surfing. The foot pocket can be made with or without a cut-out for the surfers ankle to allow greater freedom of movement of the surfer's leg. The foot pocket features a flat base for attachment to the deck of the surfboard by adhesive. The foot pocket can be of any color or combination of colors. The foot pocket is for surfers surfing with the left or right foot in the foot pocket. If the left foot is at the rear the surfer's stance is called goofy foot. If the right foot is at the rear the surfer's stance is called regular foot.

Figure 1:
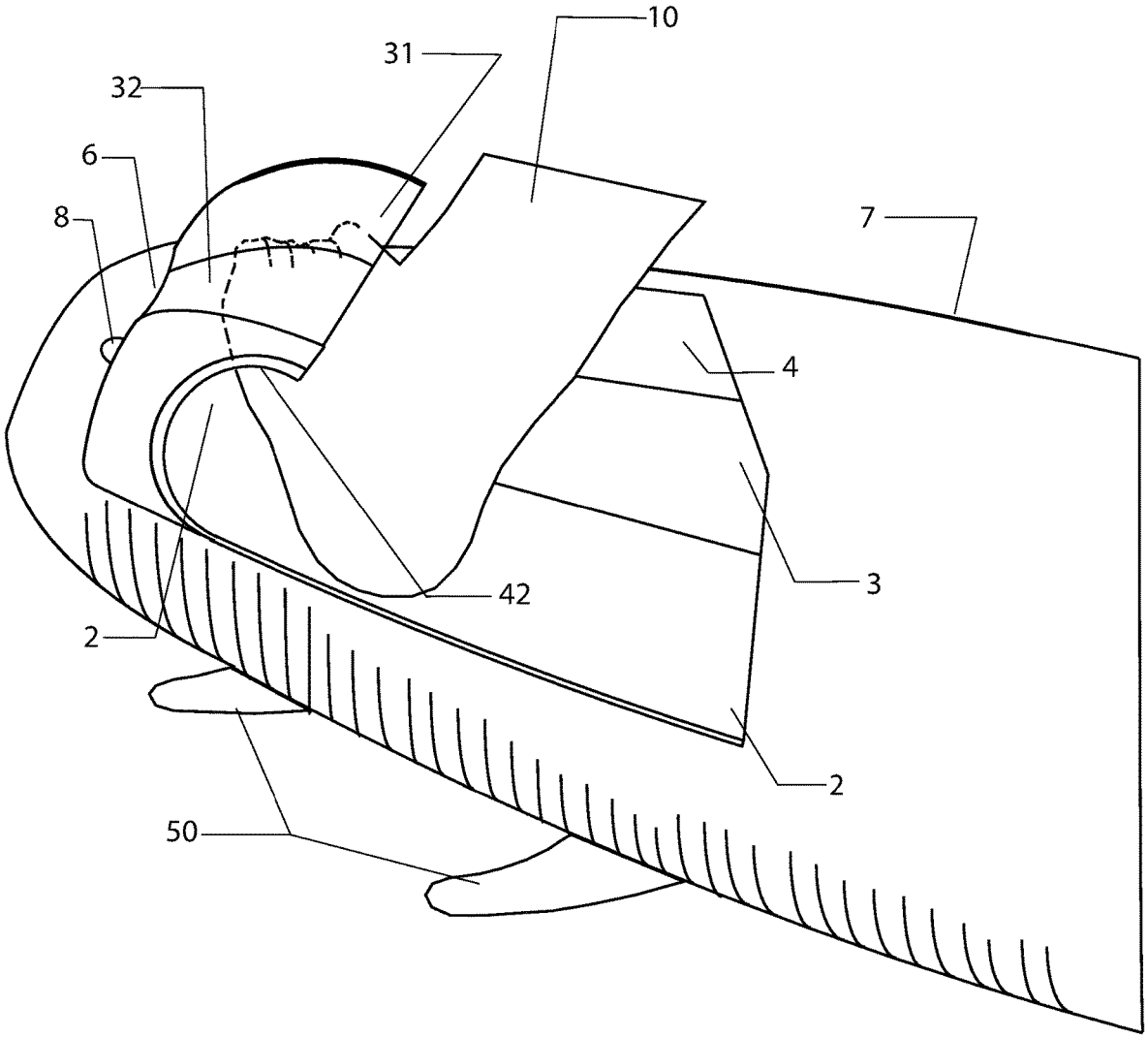
FIG. 1 is a perspective view of a surfboard equipped with a two-piece curved foot pocket with an overhang and a three piece traction pad showing placement of the surfer's foot thereon in a goofy foot stance with the left foot in the pocket area.

Referring to FIG. 1, a surfboard 7 is shown equipped with a two-piece curved foot pocket 31, 32 with a curved overhang 42 and a three piece traction pad 2, 3, 4 showing placement of the surfer's foot thereon in a goofy foot 10 stance with the left foot in the pocket area, the curved, molded main body left side 31 abutting the curved, molded main body right side 32, and the three piece traction pad material 2, 3, 4 affixed to the curved main body left 31 and right 32 sides.

Figure 2:
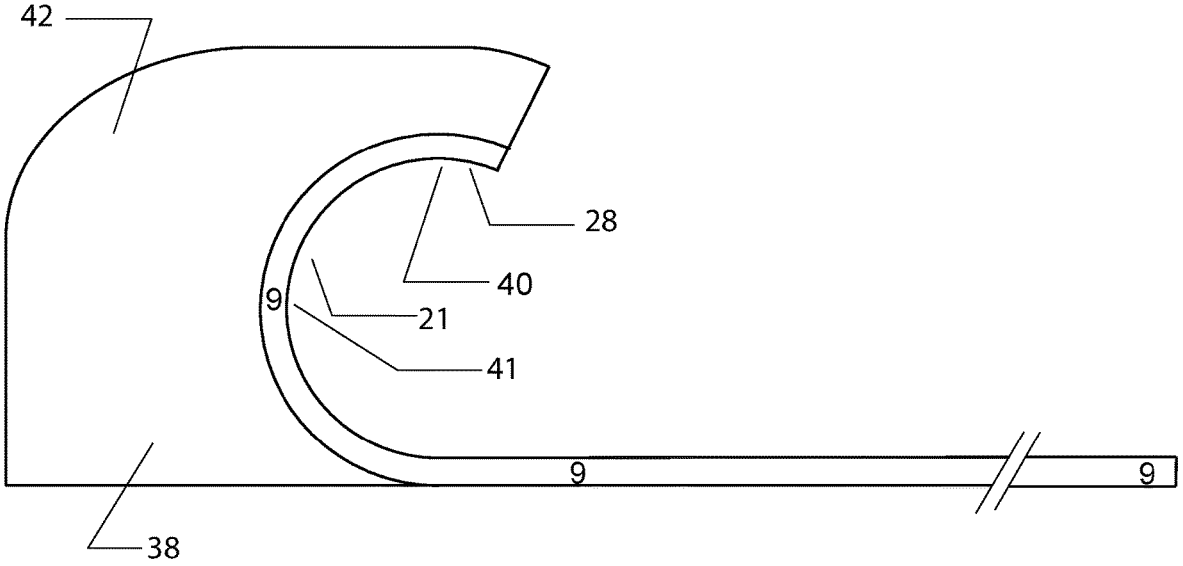
FIG. 2 is a side view of a curved and angled foot pocket.
Figure 2:
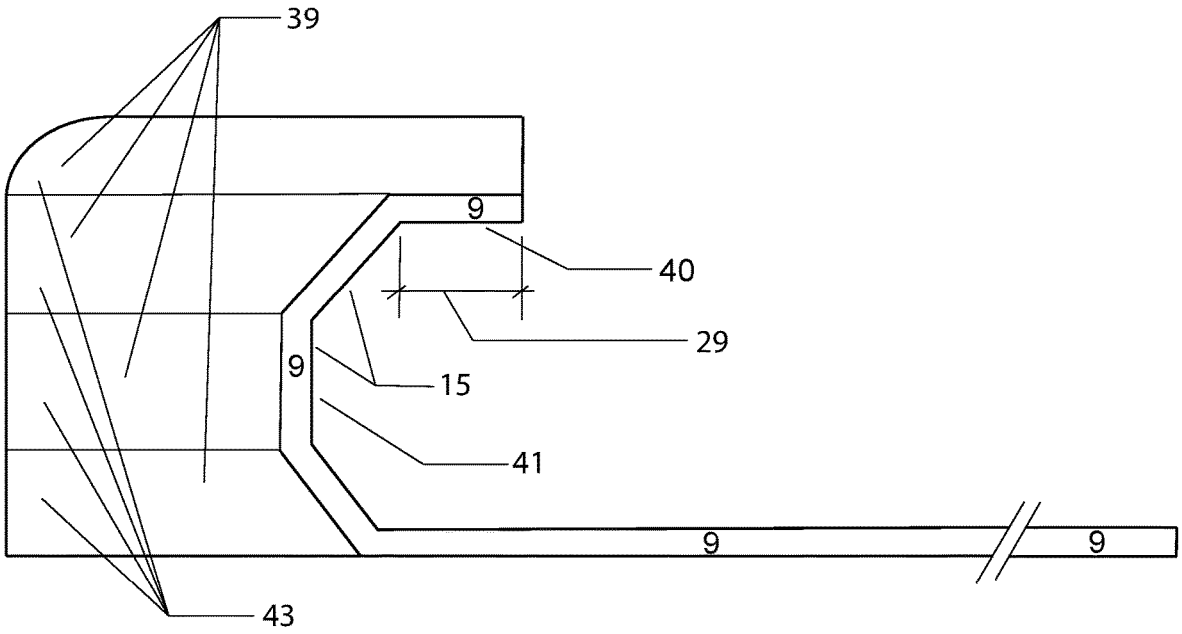

Referring to FIG. 2, a side view of a curved 21 and angled 15 foot pocket is provided in FIG. 2 shows the main body 38 manufacturing options with molded foam or layered and glued foam material. Both the curved and angled embodiment of the foot pocket can be manufactured as molded foam or layered and glued foam or plastic material. The curved 28 or horizontal 29 overhang help create the curved 21 and angled 15 foot pocket area that allows the surfer to raise the tail end of the surfboard up by pressing with the top of the rear foot against the underside 40 of the curved overhang 28. The vertical section of the curved and angled foot pocket 41 provides a surface whereon the surfer can press with the lateral side of the rear foot to push the surfboard back.

Figure 3:
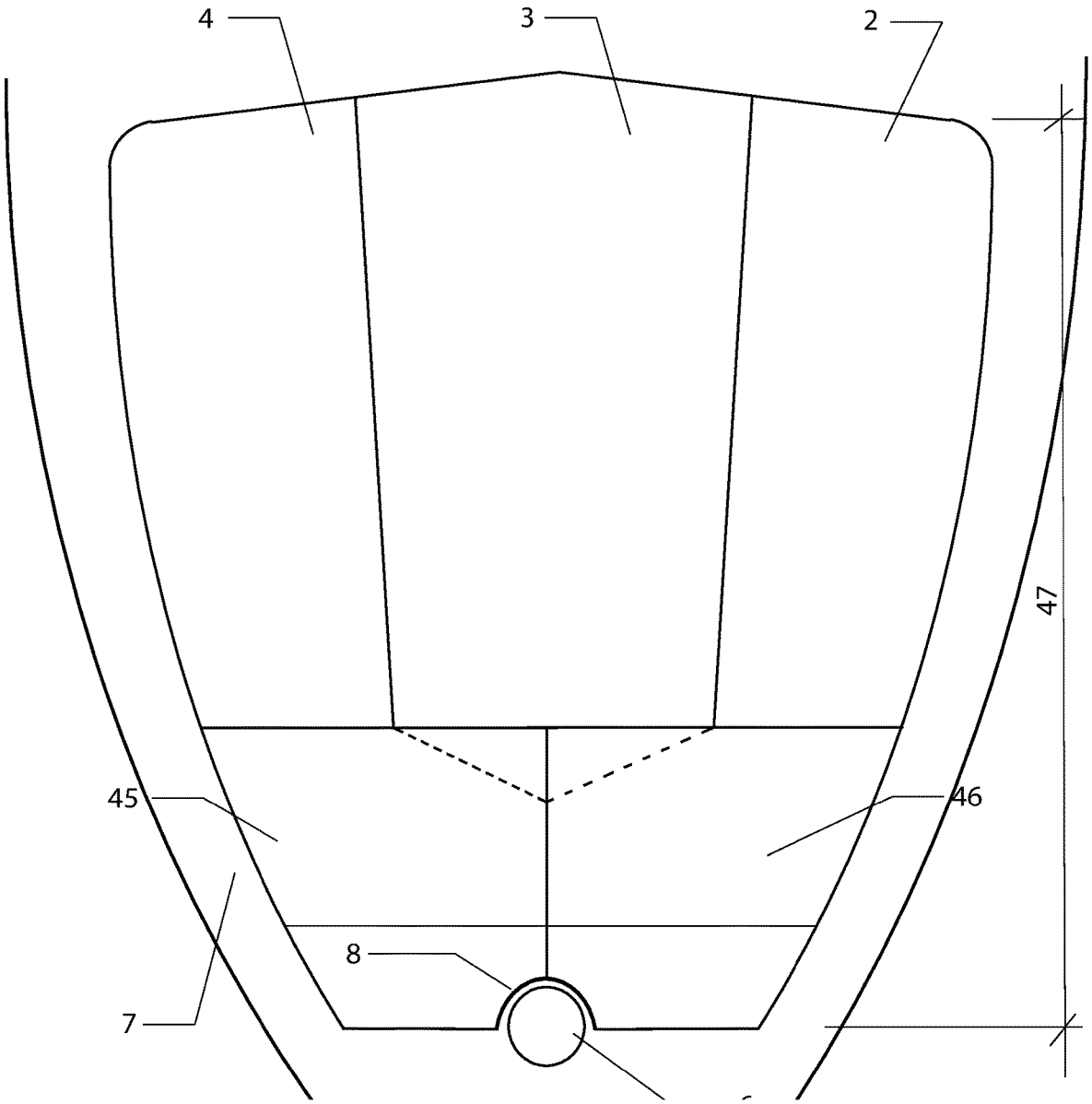
FIG. 3 is a top view of the foot pocket main body shown with a three piece traction pad.

Referring to FIG. 3, a top view of a surfboard 7 with a two-piece main body 45, 46 foot pocket is shown with a three piece traction pad 2, 3, 4, and a leash cut-out 6.

Figure 4:
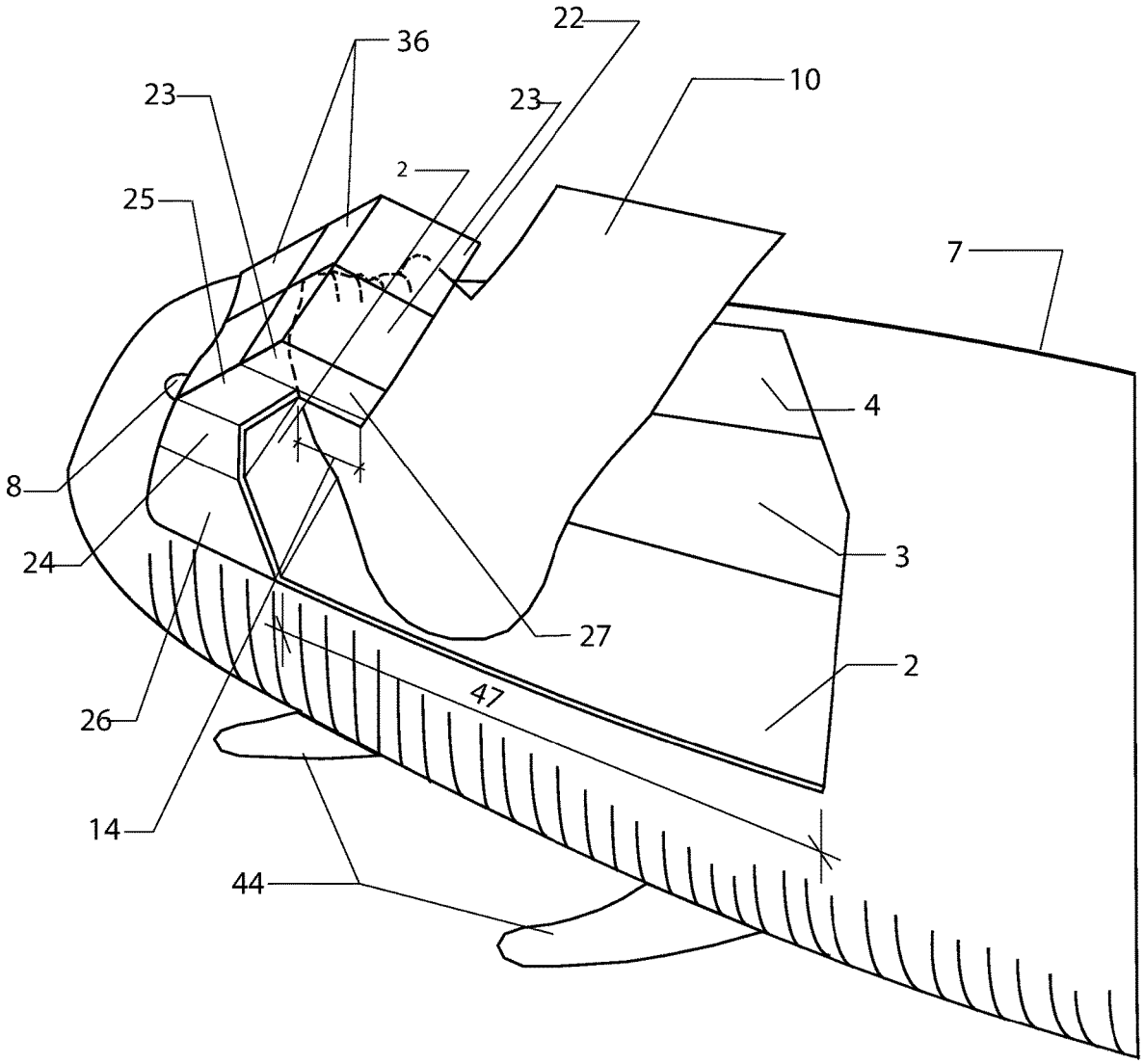
FIG. 4 is a perspective view of a surfboard equipped with a two piece angled main body, a three piece traction pad and a longer horizontal overhang with placement of the surfer's foot thereon in a goofy foot stance with the left foot in the pocket area.

Referring to FIG. 4, a surfboard 7 is shown from the right side equipped with a two piece angled main body 27, 36 having layered and glued foam showing the lower angled main body right side ramp to vertical section 26, main body right side vertical section 24, upper angled main body right side ramp to overhang section 25 and main body top section right side to overhang 23 glued together with a three piece traction pad 2, 3, 4 affixed to the underside of said main body 27 and a longer horizontal overhang 14 with placement of the surfer's foot thereon in a goofy foot stance with the left foot 10 in the pocket area. The overhang 14 can be of any length. The traction pad 47 can be of any length and is shown in this embodiment as a longer traction pad.

Figure 5:
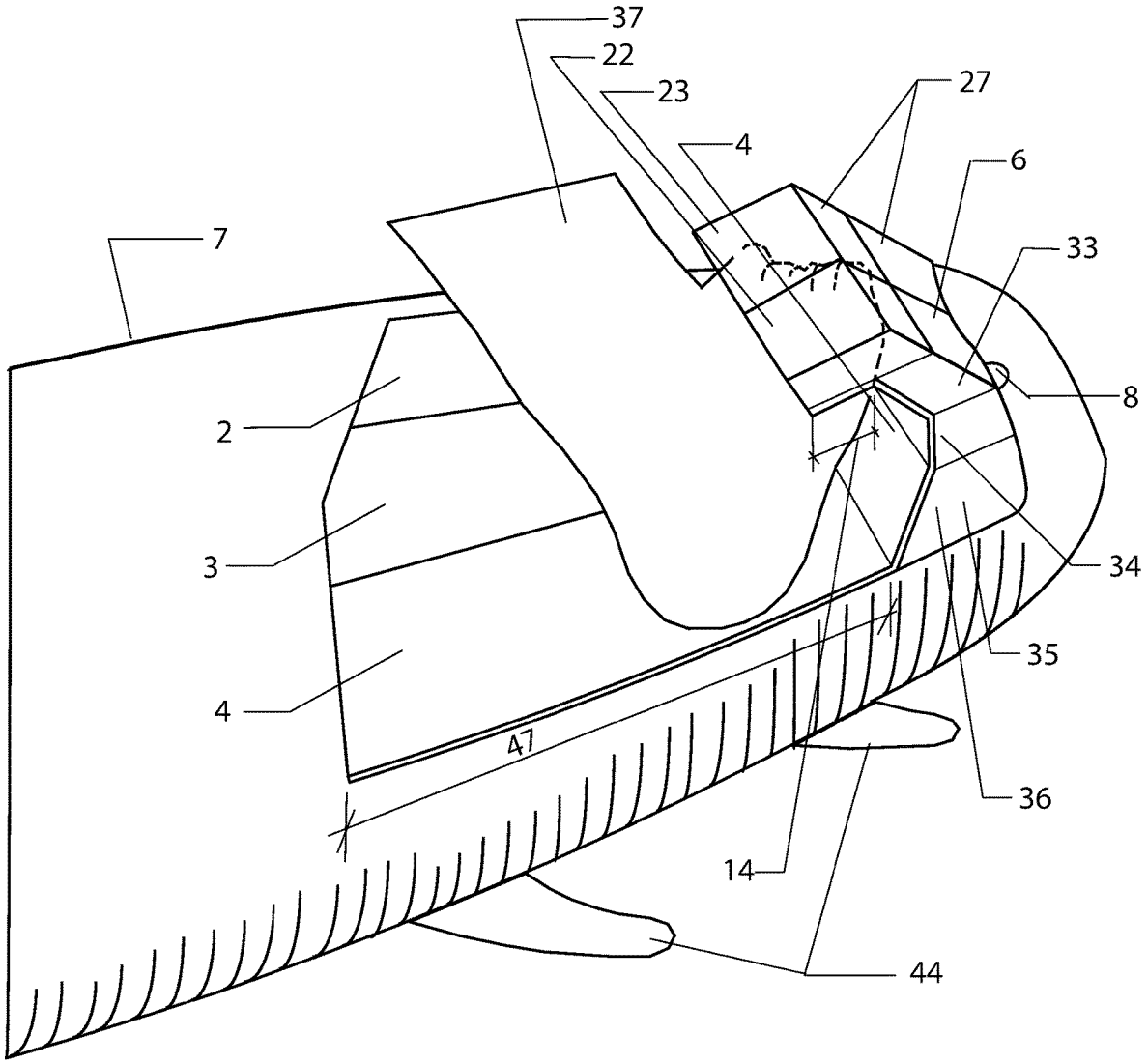
FIG. 5 is a perspective view of a surfboard equipped with an angled two-piece main body, a longer horizontal overhang and a longer three piece surfboard traction pad with the placement of the surfer's foot thereon in a regular foot stance with the right foot in the pocket area.

Referring to FIG. 5, a surfboard 7 equipped with a two piece angled main body 36, 27 having layered and glued foam is shown from the left side showing the lower angled main body left side ramp to vertical section 35, main body left side vertical section 34, upper angled main body left side ramp to overhang section 33 and main body top section left side to overhang 22 glued together with a three piece traction pad 2, 3, 4 affixed to the underside of said two-piece angled main body 36, 27 and a longer horizontal overhang 14 with placement of the surfer's foot thereon in a regular foot stance with the right foot 37 in the pocket area. The overhang 14 can be of any length. The traction pad 47 can be of any length and is shown in this embodiment as a longer traction pad.

Figure 6:
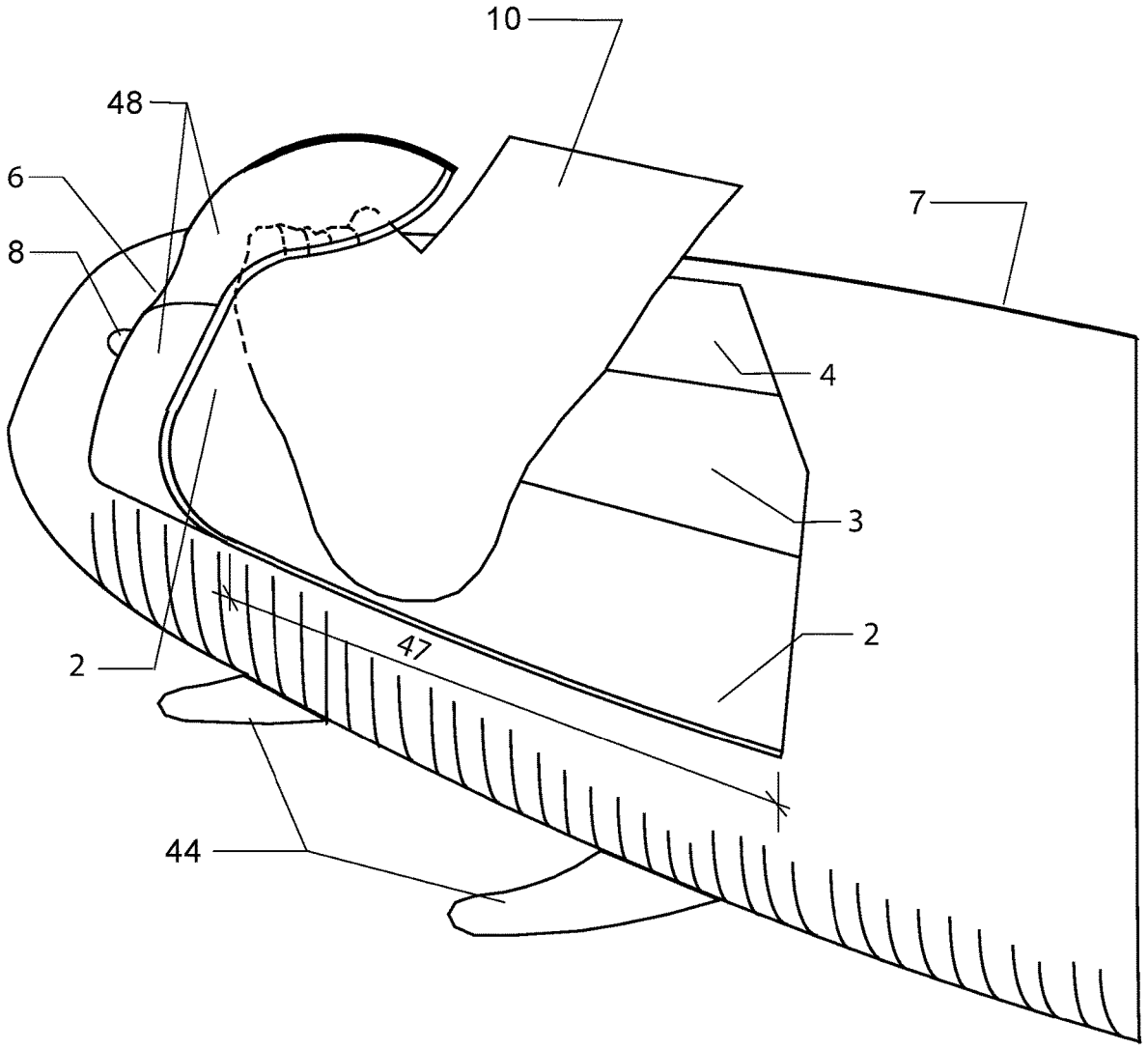
FIG. 6 is a perspective view of a surfboard equipped with a curved main body and a three piece, longer traction pad showing placement of the surfer's foot thereon in a goofy foot stance with the left foot in the pocket area with the right side of the pocket area cut out so the surfer's ankle will have greater freedom of movement.

Referring to FIG. 6, a surfboard 7 equipped with a curved main body 48 and a three piece, longer traction pad 2, 3, 4 showing placement of the surfer's foot thereon in a goofy foot stance with the left foot 10 in the pocket area with the right side of the pocket area cut out so the surfer's ankle will have greater freedom of movement. If the surfer were standing on the surfboard in a goofy foot stance with the right foot in the pocket area 37, the left side of the pocket area would be cut out so the surfer's ankle will have greater freedom of movement.

Figure 7:
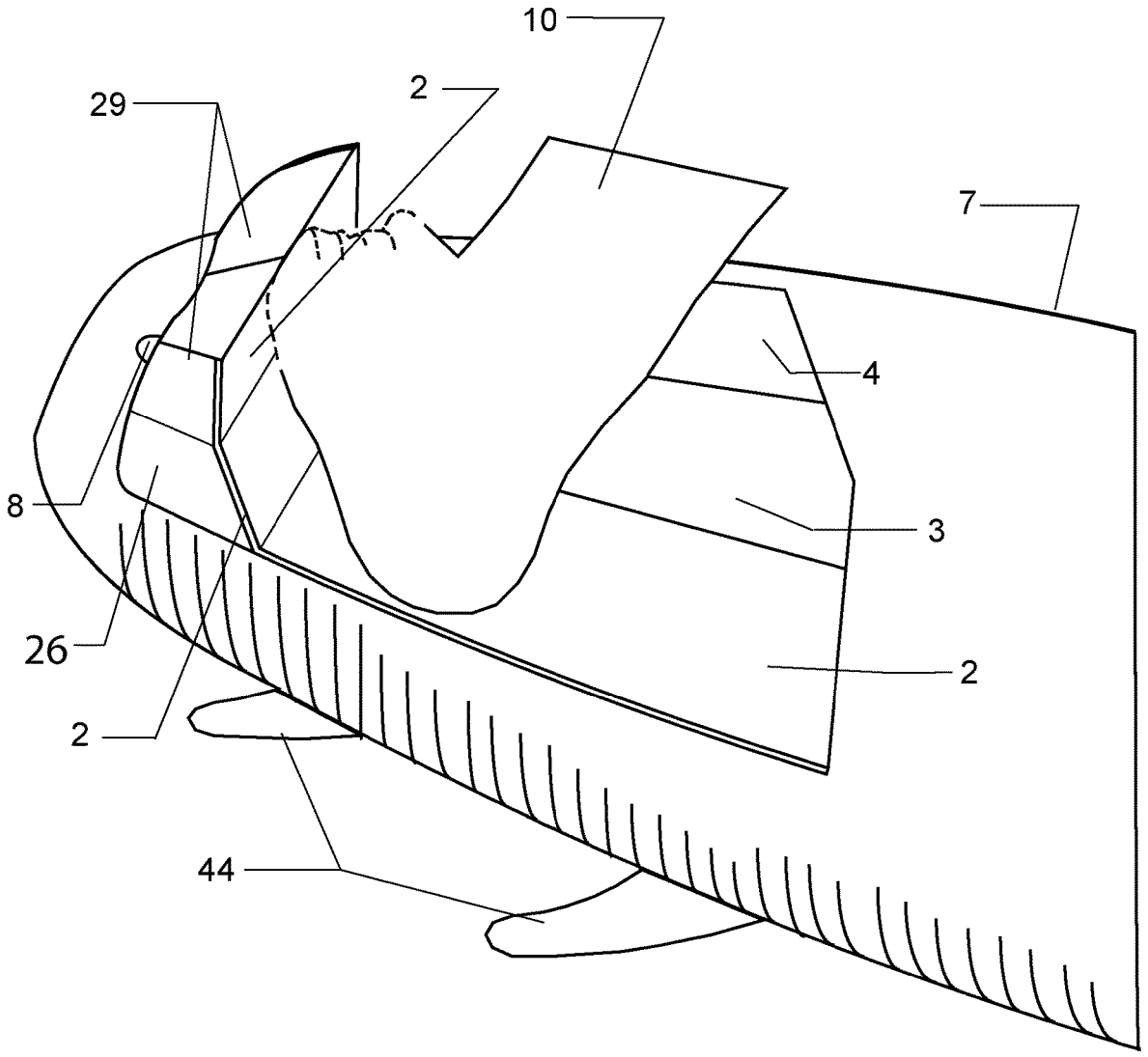
FIG. 7 is a perspective view of a surfboard equipped with an angled, vertical foot pocket main body with no overhang and a longer three piece traction pad showing placement of the surfer's foot thereon in a goofy foot stance with the left foot in the pocket area.

Referring to FIG. 7, a surfboard 7 is shown equipped with an angled, vertical, two piece foot pocket main body 26, 29 from the right side with no overhang and a longer three piece traction pad 2, 3, 4 showing placement of the surfer's foot thereon in a goofy foot stance with the left foot in the pocket area 10.

Figure 8:
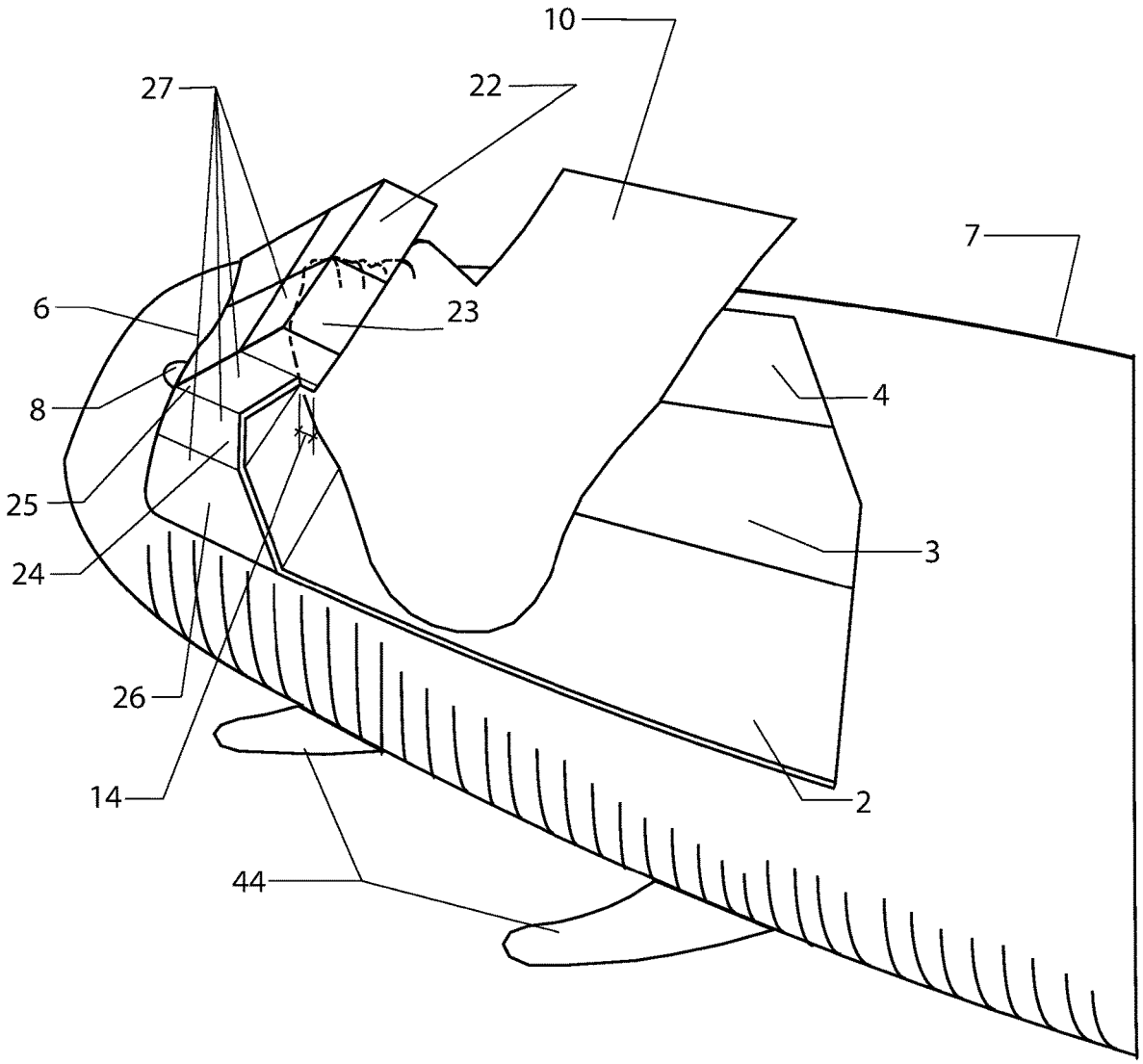
FIG. 8 is a perspective view of a surfboard equipped with an angled foot pocket main body, a longer three piece traction pad and a short horizontal overhang showing placement of the surfer's foot thereon in a goofy foot stance with the left foot in the pocket are.

Referring to FIG. 8, a surfboard 7 is shown from the right side equipped with a two piece angled main body 27, 36 having layered and glued foam showing the lower angled main body right side ramp to vertical section 26, main body right side vertical section 24, upper angled main body right side ramp to overhang section 25 and main body top section right side to overhang 23 glued together with a three piece traction pad 2, 3, 4 affixed to the underside of said main body 27 and a shorter horizontal overhang 14 with placement of the surfer's foot thereon in a goofy foot stance with the left foot 10 in the pocket area. The overhang 14 can be of any length. The traction pad 47 can be of any length and is shown in this embodiment as a longer traction pad.

Figure 9:
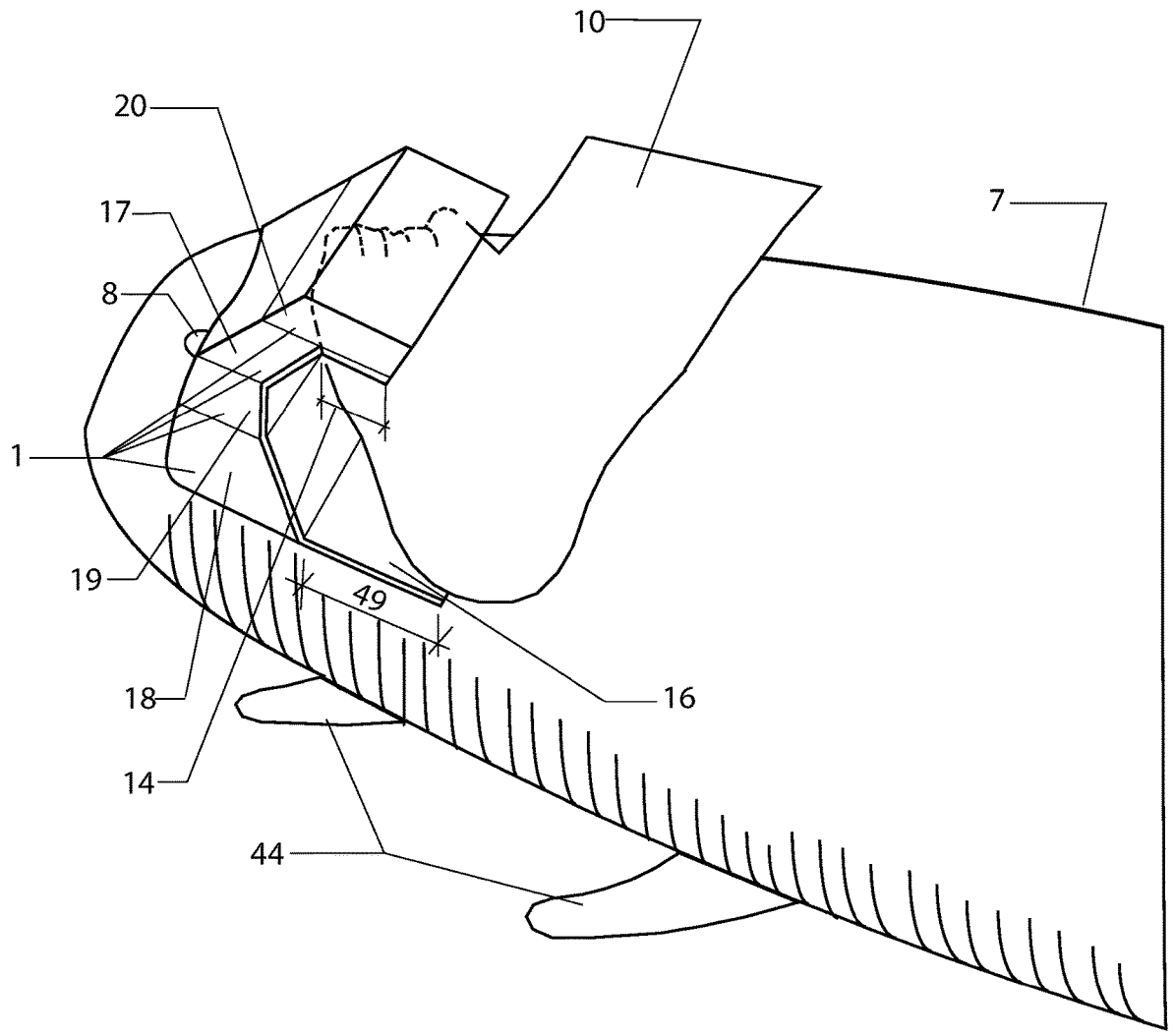
FIG. 9 is a perspective view of a surfboard 7 equipped with a one-piece angled foot pocket main body, a longer horizontal overhang, and a short single piece integrated surfboard traction pad with placement of the surfer's foot thereon in a goofy foot stance with the left foot in the pocket area.

Referring to FIG. 9, a surfboard 7 is shown equipped with a one piece angled main body 1 comprising 17, 18, 19, 20, a longer horizontal overhang 14, and a short single piece integrated surfboard traction pad 16 with placement of the surfer's foot thereon in a goofy foot stance with the left foot 10 in the pocket area.

Figure 10:
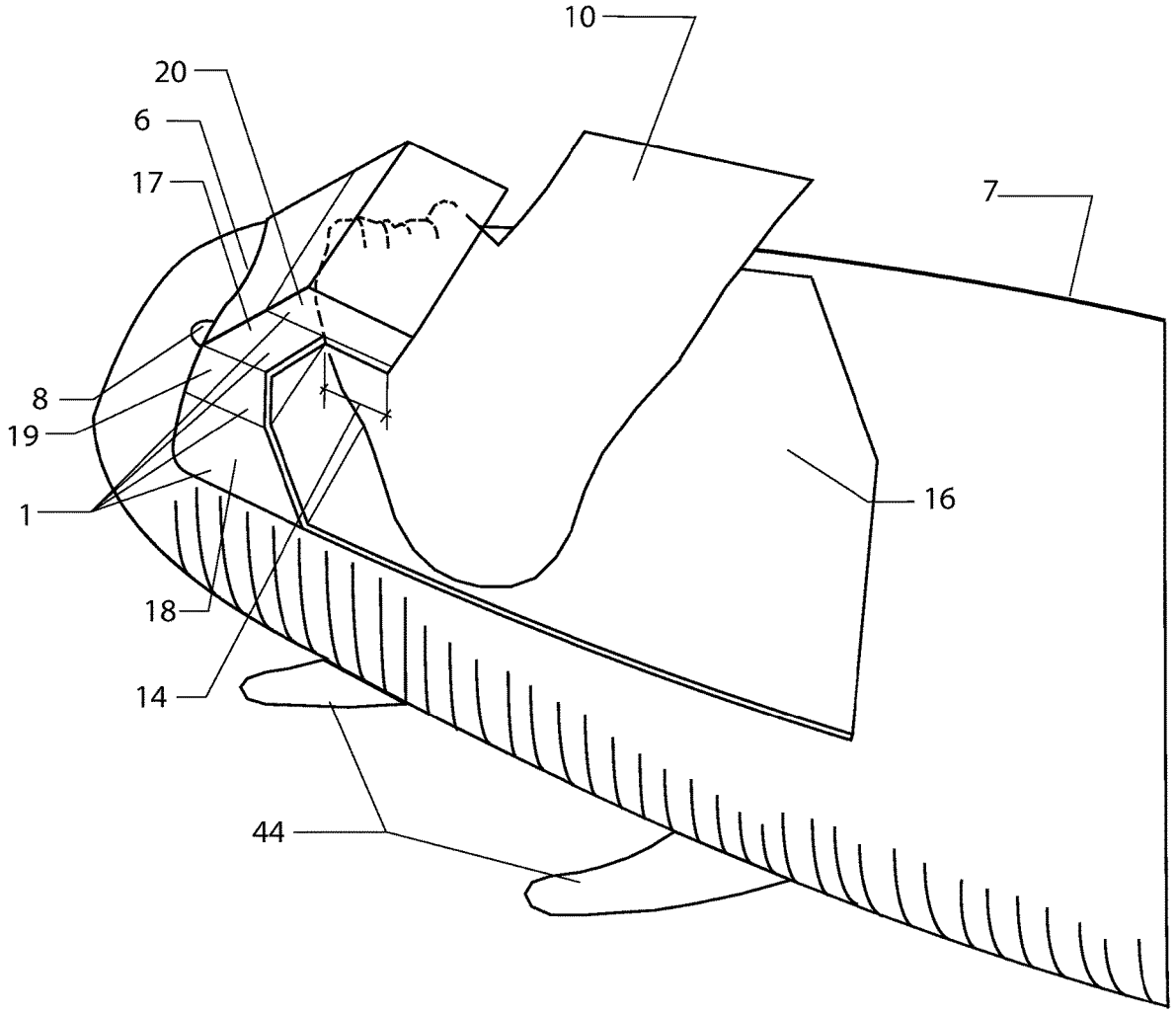
FIG. 10 is a perspective view of a surfboard equipped with an angled single piece foot pocket main body, a single piece traction pad, a longer horizontal overhang, with placement of the surfer's foot thereon in a goofy foot stance with the left foot in the pocket area.

Referring to FIG. 10, a surfboard 7 is shown equipped with a one piece angled main body 1 comprising 17, 18, 19, 20, a longer horizontal overhang 14, and a longer single piece integrated surfboard traction pad 16 with placement of the surfer's foot thereon in a goofy foot stance with the left foot 10 in the pocket area.

Figure 11:
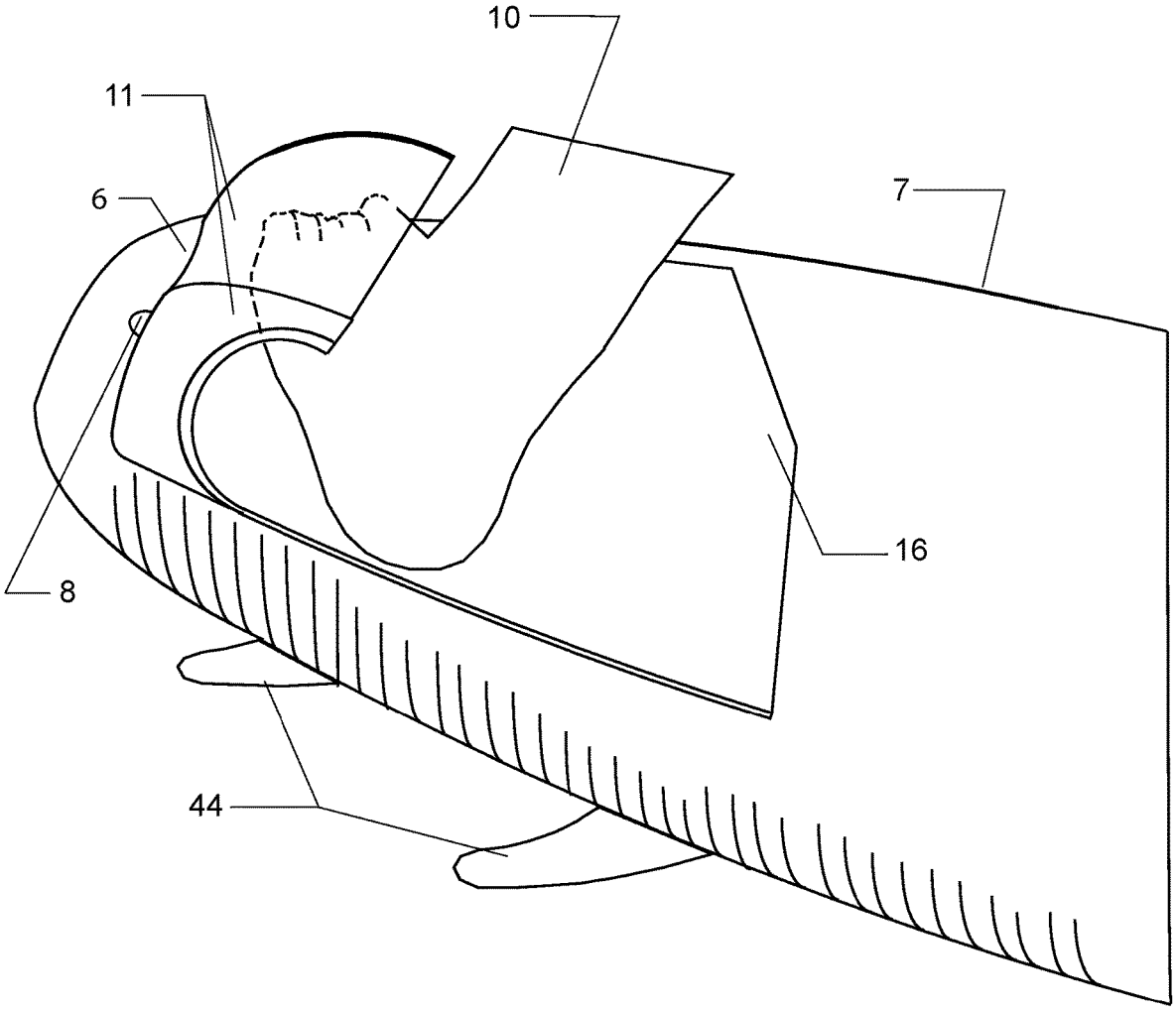
FIG. 11 is a perspective view of a surfboard equipped with a curved, single piece foot pocket main body, a single piece traction pad, and a curved overhang with placement of the surfer's foot thereon in a goofy foot stance with the left foot in the pocket area.

Referring to FIG. 11, a surfboard is shown equipped with a curved, single piece foot pocket main body 11, a single piece traction pad 16, and a curved overhang with placement of the surfer's foot thereon in a goofy foot stance with the left foot 10 in the pocket area.

Figure 12:
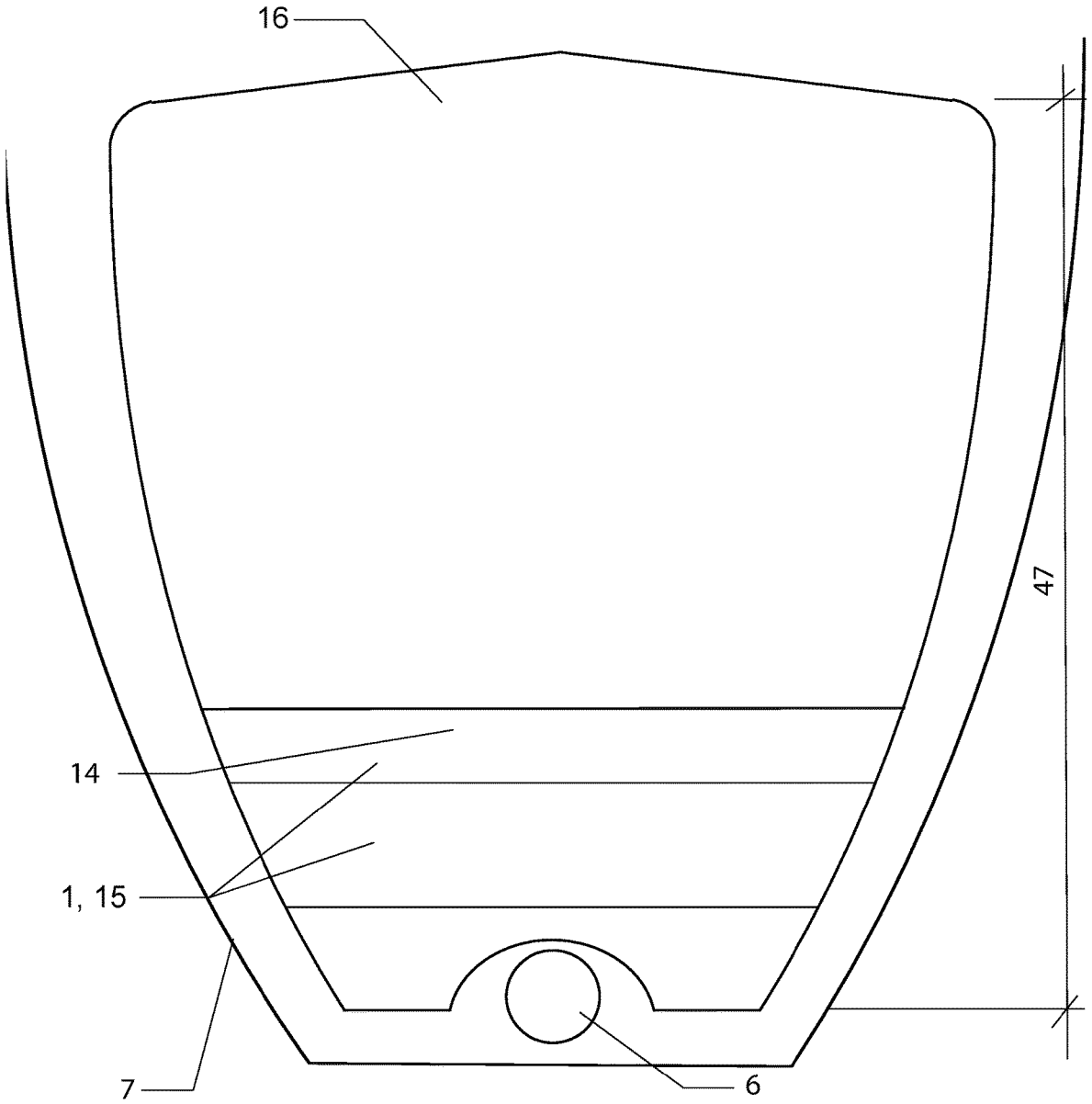
FIG. 12 is a top view of the foot pocket and single piece traction pad.

Referring to FIG. 12, a top view of the foot pocket main body 1, 15, leash cut-out 6, and longer single piece traction pad 16, 47 is shown.

Figure 13:
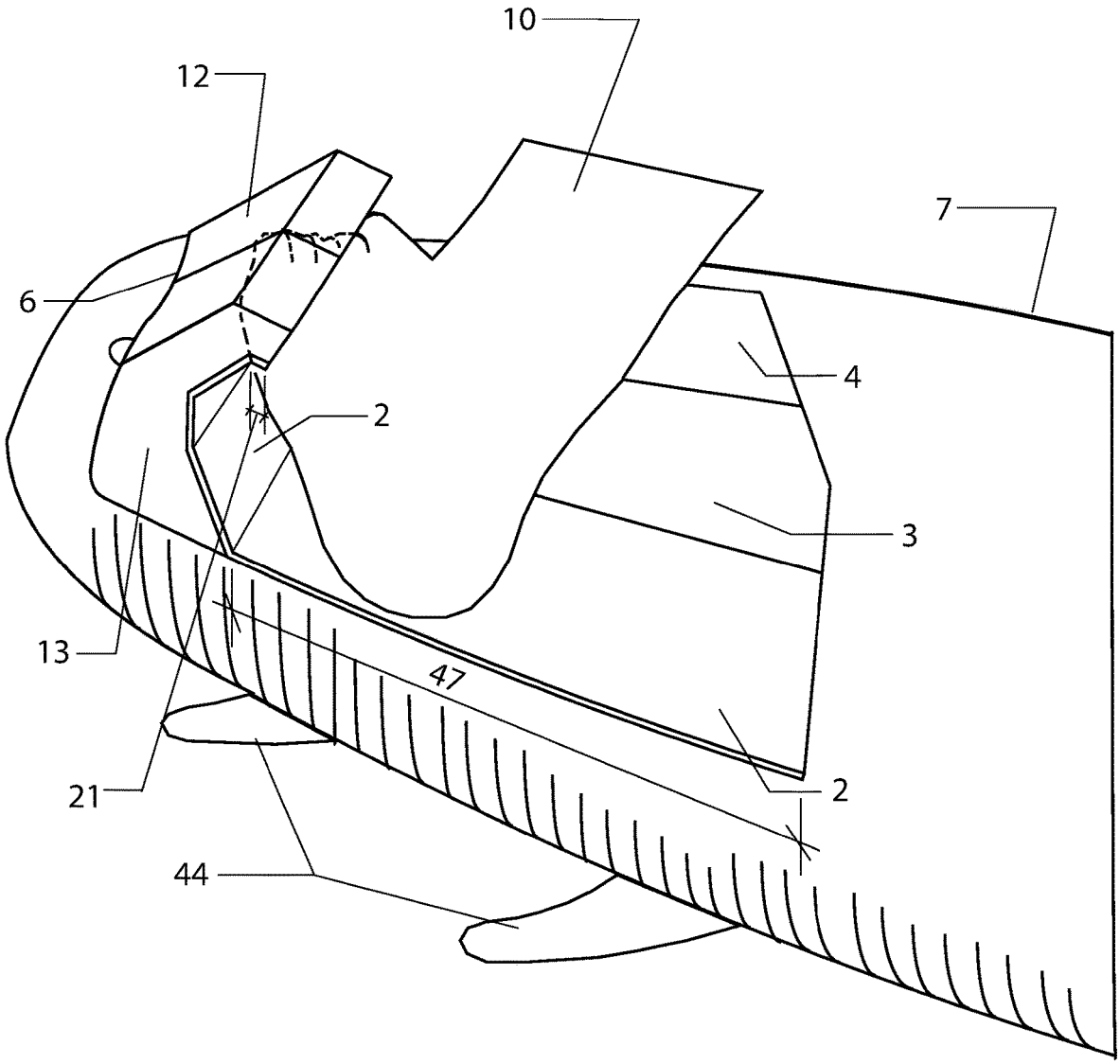
FIG. 13. is a perspective view of a surfboard equipped with a two piece angled foot pocket main body, a three piece traction pad and a shorter horizontal overhang with placement of the surfer's foot thereon in a goofy foot stance with the left foot in the pocket area.

Referring to FIG. 13, a surfboard 7 is shown with a two piece angled foot pocket main body made from molded material such as foam 12, 13, a longer three piece traction pad 2, 3, 4, 47 and a shorter, molded horizontal overhang 21 with placement of the surfer's foot thereon in a goofy foot stance with the left foot in the pocket area 10.

Figure 14:
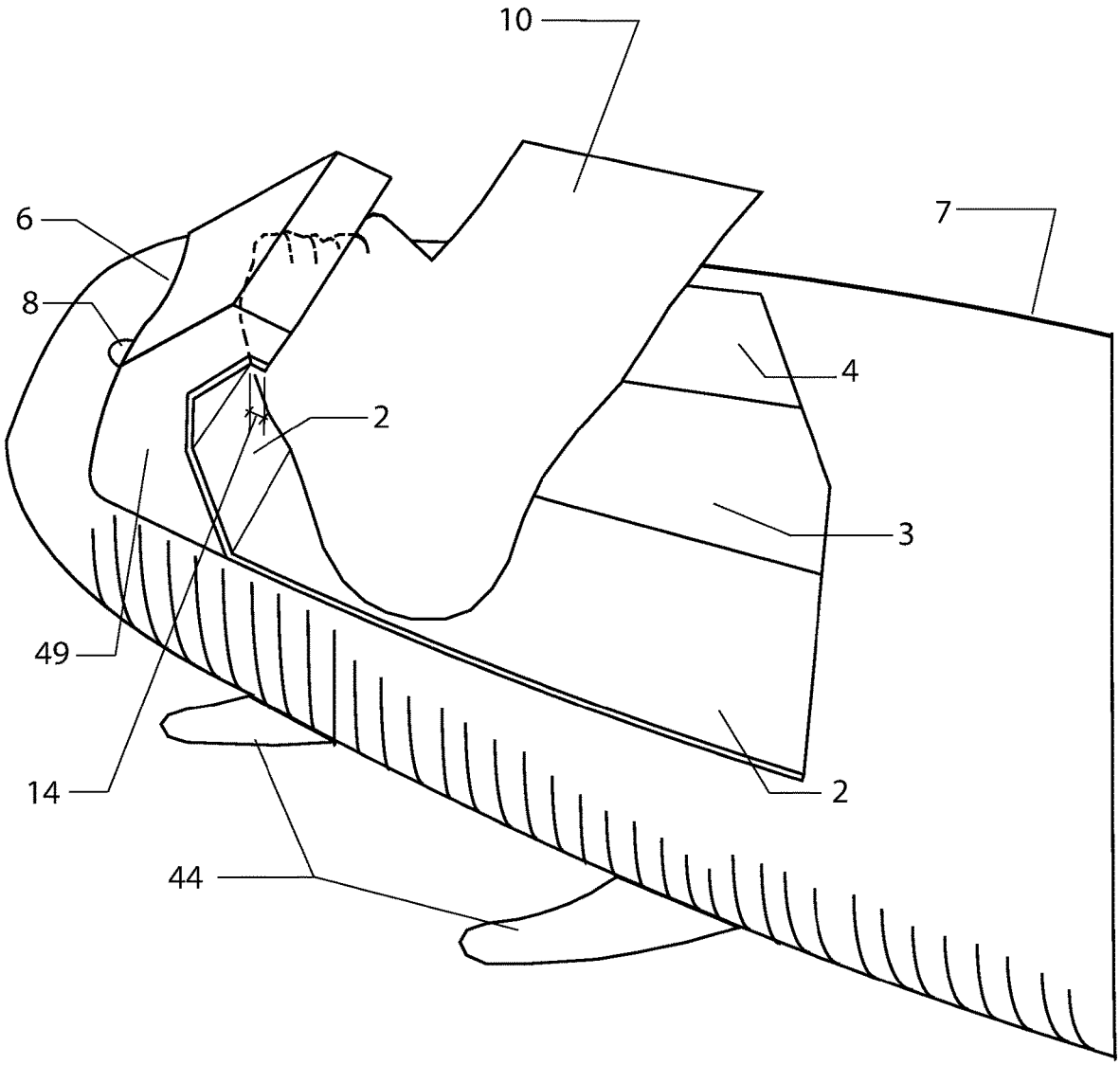
FIG. 14 is a perspective view of a surfboard equipped with a one piece angled foot pocket main body, a three piece traction pad and a shorter horizontal overhang with placement of the surfer's foot thereon in a goofy foot stance with the left foot in the pocket area.

Referring to FIG. 14, a surfboard is shown with a one piece angled foot pocket main body 49, a three piece traction pad 2, 3, 4 and a shorter horizontal overhang 14 with placement of the surfer's foot thereon in a goofy foot stance with the left foot in the pocket area 10.

Figure 15:
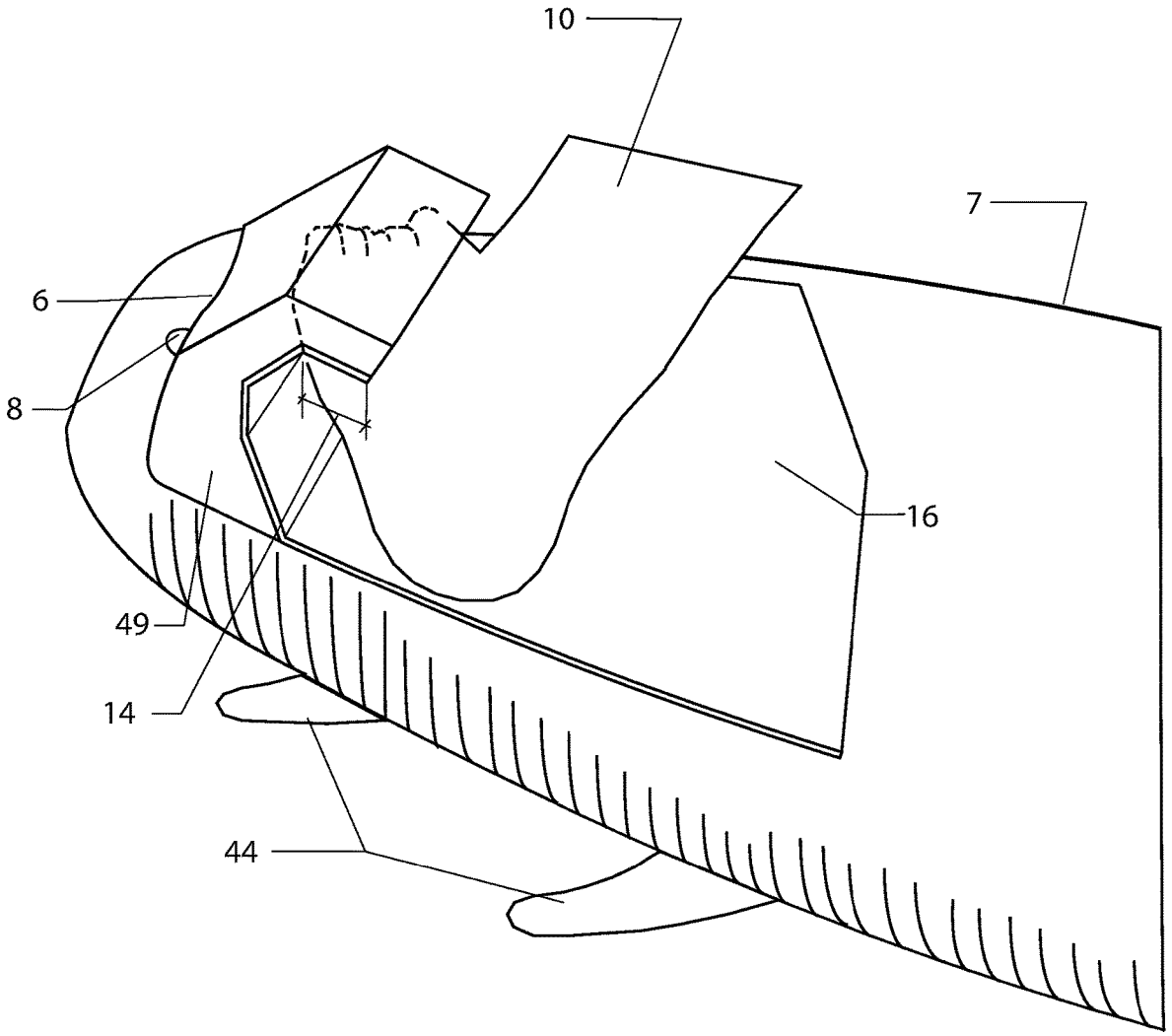
FIG. 15 shows a foot pocket with a 1 piece, angled main body made with molded material, a horizontal overhang, a single piece traction pad, with placement of the surfer's foot thereon in a goofy foot stance with the left foot in the pocket area.

Referring to FIG. 15, a surfboard is shown with a one piece angled foot pocket main body 49, a one piece traction pad 16, and a longer horizontal overhang 14 with placement of the surfer's foot thereon in a goofy foot stance with the left foot in the pocket area 10.

Figure 16:
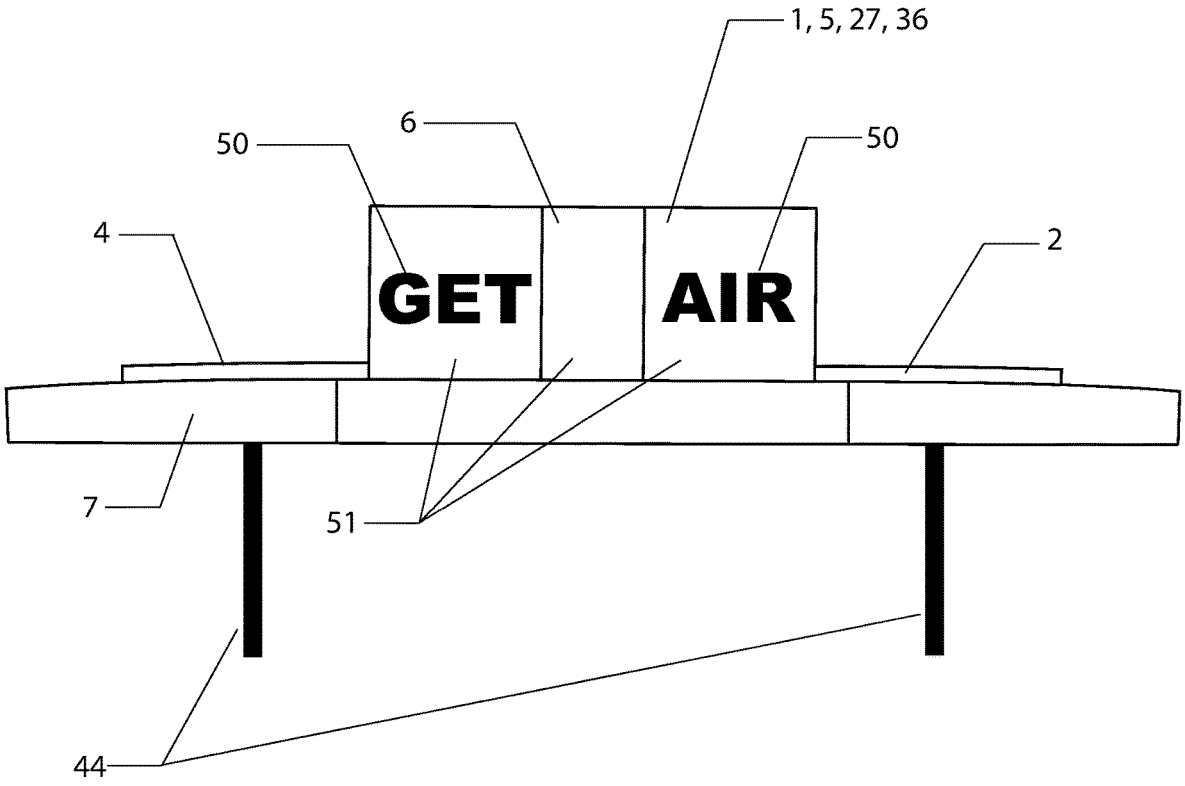
FIG. 16 shows a foot pocket rear view and the preferred product advertising message displayed on the vertical backside of said foot pocket.

Referring to FIG. 16, a surfboard 7 is shown with a foot pocket main body 1, 5, 27, 36 and traction pad 2, 4 from the rear with product name, branding, and/or advertising messaging 50 displayed on the vertical rear end 51 of said foot pocket. Said product name, branding, and/or advertising message preferably is the words "Get Air" but can be any number or choice of words in any language with or without an accompanying logo or graphic design. The product name, branding, and/or advertising messaging 50 displayed on the vertical rear end 51 of said foot pocket may be carved into and/or stamped with permanent ink upon the main body 1, 5, 27, 36 of the foot pocket, or may be carved into or stamped with permanent ink upon a separate piece of EVA foam attached to the rear of the foot pocket main body 1, 5, 27, 36 with adhesive.

GLOSSARY OF NUMBERED DESCRIPTIONS

1 One-piece angled main body comprising 17, 18, 19,
2 Surfboard traction pad right piece
3 Surfboard traction pad center piece
4 Surfboard traction pad left piece
5 One-piece molded, angled main body
6 Leash cut-out
7 Surfboard
8 Leash pin hole
9 Traction pad
10 Surfers left (rear) foot (goofy foot stance)
11 Curved one-piece main body
12 Angled and molded main body left piece
13 Angled and molded main body right piece
14 Overhang
15 Angled Foot Pocket Area
16 Single-piece traction pad
17 Upper angled main body ramp to overhang section
18 Lower angled main body ramp to vertical section
19 Main body vertical section
20 Main body horizontal overhang section
21 Curved Foot Pocket Area
22 Main body top section left side to overhang
23 Main body top section right side to overhang
24 Main body right side vertical section
25 Upper angled main body right side ramp to overhang section
26 Lower angled main body right side ramp to vertical section
27 Right side angled two-piece main body comprising 23,24,25,26
28 Curved overhang
29 Horizontal Overhang
30 Curved main body with ankle cut-out
31 Curved, molded main body left side
32 Curved, molded main body right side
33 Upper angled main body left side ramp to overhang section
34 Main body left side vertical section
35 Lower angled main body left side ramp to vertical section
36 Left side angled two-piece main body comprising 22,33, 34,35
37 Surfers right (Rear) foot (regular foot stance)
38 Curved, molded main body side view
39 Angled main body side view
40 Underside of overhang
41 Vertical Section of the foot pocket
42 Molded foam
43 Layered and glued foam
44 Surfboard fins
45 Main body, molded or glued left side 46 Main body, molded or glued right side
47 Longer traction pad 48 Curved one-piece main body with ankle cut-out
49 Shorter traction pad 50 Advertising message 51 Vertical face of main body

The invention claimed is:

1. A surfboard foot pocket for a surfboard having a nose and tail, comprising: a main body 39 with an overhang 14 and a traction pad 2,3, 4, 9, 16, 47, the main body has a front side of a plurality of angled 27, 36, and vertical 19 surfaces and with an overhang 14 at a front side of sufficient length to create a pocket for a surfer's rear foot 15 which allows the foot to maintain a secure point of contact with the surfboard between the top and the bottom of the foot so that the foot does not become disengaged with the surfboard while attempting to push the tail end of the surfboard back with the side of the foot and/or lift the tail end of the surfboard up with the top of the foot when surfing a wave, the main body front side 39 has a plurality of angled and vertical surfaces with the traction pad 9 being permanently affixed to the front side of the main body with adhesive and extends forward past the front of the main body towards the nose of the surfboard, affixed to the surfboard with adhesive, as far as needed to provide optimum traction for the surfer's rear foot while surfing.

* * * * *